US011441407B2

(12) United States Patent
Rowland et al.

(10) Patent No.: US 11,441,407 B2
(45) Date of Patent: Sep. 13, 2022

(54) SHEATH ENCAPSULATION TO CONVEY ACID TO FORMATION FRACTURE

(71) Applicant: Saudi Arabian Oil Company, Dhahran (SA)

(72) Inventors: Gregory Louis Rowland, Udhailiyah (SA); Abdulaziz M. Sagr, Al-Jishah (SA)

(73) Assignee: Saudi Arabian Oil Company, Dhahran (SA)

( * ) Notice: Subject to any disclaimer, the term of this patent is extended or adjusted under 35 U.S.C. 154(b) by 105 days.

(21) Appl. No.: 16/901,790

(22) Filed: Jun. 15, 2020

(65) Prior Publication Data

US 2021/0388708 A1 Dec. 16, 2021

(51) Int. Cl.
*E21B 27/00* (2006.01)
*E21B 43/117* (2006.01)
(Continued)

(52) U.S. Cl.
CPC ..... *E21B 43/27* (2020.05); *E21B 27/00* (2013.01); *E21B 43/117* (2013.01); *E21B 43/26* (2013.01); *E21B 47/06* (2013.01)

(58) Field of Classification Search
CPC ..... E21B 27/00; E21B 43/117; E21B 43/26; E21B 43/27; E21B 47/06
See application file for complete search history.

(56) References Cited

U.S. PATENT DOCUMENTS 2,080,875 A * 5/1937 Pitzer ..... C09K 8/536 166/299
4,633,951 A * 1/1987 Hill ..... E21B 43/267 166/297
(Continued)

FOREIGN PATENT DOCUMENTS

CN 1886574 11/2012
EP 0931907 A2 * 7/1999 ..... E21B 43/117
(Continued)

OTHER PUBLICATIONS

Diaz et al., "An Evaluation of the Impact of Reactive Perforating Charges on Acid Wormholing in Carbonates," SPE Latin American and Caribbean Petroleum Engineering Conference, Lima, Peru, SPE-138434-MS, Dec. 2010, 11 pages.
(Continued)

*Primary Examiner* — Daniel P Stephenson
(74) *Attorney, Agent, or Firm* — Fish & Richardson P.C.

(57) ABSTRACT

A well tool includes a perforating gun including multiple shaped charges, a sheath encapsulating the perforating gun and powdered acid in an internal chamber defined by the sheath. The perforating gun is lowered to a depth into a wellbore formed in a subterranean zone. The multiple shaped charges are fired to form multiple perforations in the wellbore at the depth. The multiple perforations provide access to the subterranean zone at the depth. The sheath, which covers at least some of the multiple shaped charges, breaks responsive to at least some of the multiple shaped charges being fired. The powdered acid in the internal chamber is applied to the subterranean zone responsive to the multiple shaped charges being fired. The powdered acid reacts with and weakens the subterranean zone at the depth to ease flow of hydraulic fracturing fluid into the subterranean zone at the depth.

16 Claims, 4 Drawing Sheets

(51) Int. Cl.

| | |
|---|---|
| ***E21B 43/26*** | (2006.01) |
| ***E21B 43/27*** | (2006.01) |
| *E21B 47/06* | (2012.01) |

(56) References Cited

U.S. PATENT DOCUMENTS

| | | | | |
|---|---|---|---|---|
| 6,082,450 | A * | 7/2000 | Snider | E21B 37/08 166/55.2 |
| 6,336,506 | B2 * | 1/2002 | Wesson | E21B 37/08 166/308.1 |
| 7,216,708 | B1 * | 5/2007 | Bond | E21B 43/117 166/297 |
| 7,819,064 | B2 | 10/2010 | Saenger et al. | |
| 7,909,115 | B2 | 3/2011 | Grove et al. | |
| 7,913,761 | B2 * | 3/2011 | Pratt | E21B 43/26 166/297 |
| 9,133,695 | B2 | 9/2015 | Xu | |
| 2004/0099418 | A1 * | 5/2004 | Behrmann | E21B 43/04 166/312 |
| 2008/0282924 | A1 | 11/2008 | Saenger et al. | |
| 2009/0078420 | A1 | 3/2009 | Caminari et al. | |
| 2010/0065274 | A1 * | 3/2010 | Haney | E21B 43/117 166/297 |
| 2010/0252253 | A1 * | 10/2010 | Walton | E21B 43/263 166/177.5 |
| 2011/0094406 | A1 | 4/2011 | Marya et al. | |
| 2013/0180701 | A1 * | 7/2013 | Clay | C09K 8/72 166/55 |
| 2013/0192829 | A1 * | 8/2013 | Fadul | E21B 43/11 166/297 |
| 2017/0234116 | A1 | 8/2017 | Gilliat et al. | |
| 2021/0388708 | A1 * | 12/2021 | Rowland | E21B 43/26 |

FOREIGN PATENT DOCUMENTS

| | | | | |
|---|---|---|---|---|
| EP | 1918507 | | 5/2008 | |
| WO | WO-2008066572 | A2 * | 6/2008 | F42B 3/22 |
| WO | WO-2020150232 | A1 * | 7/2020 | E21B 43/28 |

OTHER PUBLICATIONS

PCT International Search Report and Written Opinion in International Appln. No. PCT/US2021/036366, dated Oct. 1, 2021, 13 pages.

* cited by examiner

SHEATH ENCAPSULATION TO CONVEY ACID TO FORMATION FRACTURE

TECHNICAL FIELD

This disclosure relates to wellbore operations, for example, perforating a wellbore and hydraulically fracturing a subterranean zone in which the wellbore is formed.

BACKGROUND

Hydrocarbons entrapped in subsurface reservoirs are produced (that is, raised) to the surface by forming wellbores in the subterranean zone that includes the subsurface reservoirs. A subterranean zone is a formation, a portion of a formation, or multiple formations from the surface of the Earth to the subsurface reservoir. A wellbore is drilled into the subterranean zone from the surface to the subsurface reservoir. A wellbore can be cased or open. A cased wellbore includes a string of tubing (called casing) lowered into the wellbore and held in place by cement in an annulus defined by an outer wall of the casing and an inner wall of the wellbore. The wellbore can be lined with multiple casings. An open wellbore is one without a casing. A wellbore can sometimes be partially cased and partially open.

Sometimes, the formation pressure (that is, the pressure under which the hydrocarbons are entrapped in the subterranean zone) is sufficiently high or the subterranean zone is sufficiently permeable (or both) to allow the hydrocarbons to flow into the wellbore without external intervention. Other times, the formation pressure is too low or permeability is insufficient necessitating external intervention to allow the hydrocarbons to flow into the wellbore. Hydraulic fracturing is an operation in which fracturing fluids are flowed into the formation at a fracturing pressure that causes the subterranean zone to fracture creating fluid conductivity pathways through which the hydrocarbons flow into the wellbore. Hydraulic fracturing operations are aided by mechanical, chemical and thermal techniques applied to the inner wall of the wellbore or otherwise weakening the wall of the wellbore prior to the hydraulic fracturing operation. Perforating the production casing and creating a perforation that extends into the reservoir is one technique to help aid in initiation of fractures, while applying reactive acids is one technique to weaken the wall of the wellbore.

SUMMARY

This disclosure describes technologies relating to sheath encapsulation to convey acid to formation fracture.

Certain aspects of the subject matter described here can be implemented as a well tool that includes a perforating gun including multiple shaped charges, a sheath encapsulating the perforating gun and powdered acid in an internal chamber defined by the sheath. The perforating gun is configured to be lowered to a depth into a wellbore formed in a subterranean zone. The multiple shaped charges are configured to be fired to form multiple perforations in the wellbore at the depth. The multiple perforations provide access to the subterranean zone at the depth. The sheath covers at least some of the multiple shaped charges. The sheath is configured to break responsive to at least some of the multiple shaped charges being fired. The sheath defines the internal chamber. The powdered acid is configured to react with the subterranean zone when applied to the subterranean zone responsive to at least some of the multiple shaped charges being fired. The powdered acid is configured to react with and weaken the subterranean zone at the depth to ease flow of hydraulic fracturing fluid into the subterranean zone at the depth.

An aspect combinable with any other aspect can include the following features. The sheath is a hollow, annular member including an inner wall and an outer wall connected by a first end wall and a second end wall. The sheath encapsulates an entire length of the perforating gun and substantially the ends of the perforating gun.

An aspect combinable with any other aspect can include the following features. The sheath defines an inner diameter that is at least as large as an outer diameter of the perforating gun.

An aspect combinable with any other aspect can include the following features. The internal chamber is defined between the inner wall, the outer wall, the first end wall and the second end wall. A volume of the internal chamber is sufficient to carry a quantity of the powdered acid needed to weaken the subterranean zone at the depth to ease flow of hydraulic fracturing fluid into the subterranean zone at the depth upon application of the quantity to the subterranean zone at the depth responsive to at least some of the multiple shaped charges being fired.

An aspect combinable with any other aspect can include the following features. Responsive to at least some of the multiple shaped charges being fired, the sheath is configured to separate from the perforating gun.

An aspect combinable with any other aspect can include the following features. The powdered acid is configured to not react with the sheath or the perforating gun before or after at least some of the plurality of shaped charges are fired.

An aspect combinable with any other aspect can include the following features. The powdered acid includes at least one of hydrochloric acid, hydrofluoric acid, acetic acid or formic acid.

An aspect combinable with any other aspect can include the following features. The tool includes a wireline coupled to the sheath. The wireline is configured to lower the well tool into the wellbore to the depth.

Certain aspects of the subject matter described here can be implemented as a method. A perforating gun fires multiple shaped charges at a depth in a wellbore formed in a subterranean zone to form multiple perforations in the wellbore to provide access to the subterranean zone at the depth. Responsive to firing the multiple shaped charges, a sheath carrying powdered acid and encapsulating the perforating gun releases the powdered acid onto the subterranean zone through the multiple perforations. The powdered acid reacts with and weakens the subterranean zone at the depth to ease flow of hydraulic fracturing fluid into the subterranean zone at the depth.

An aspect combinable with any other aspect can include the following features. The released powdered acid is flowed into the subterranean zone at the depth after releasing the powdered acid responsive to firing the multiple shaped charges.

An aspect combinable with any other aspect can include the following features. The released powdered acid is flowed into the subterranean zone by mixing the released powdered acid with a fluid flowed from a surface of the wellbore into the subterranean zone at the depth.

An aspect combinable with any other aspect can include the following features. Periodically, a decrease in a pressure over time to flow the fluid into the subterranean zone is measured. Flow of the fluid from the surface of the wellbore into the subterranean zone at the depth is continued until the pressure reaches a threshold pressure value.

An aspect combinable with any other aspect can include the following features. A hydraulic fracturing of the subterranean zone at the depth is initiated after flowing the released powdered acid into the subterranean zone.

Certain aspects of the subject matter described here can be implemented as a method. A sheath is filled with powdered acid that is configured to react with a subterranean zone when applied to the subterranean zone to weaken the subterranean zone to ease flow of hydraulic fracturing fluid into the subterranean zone. The sheath is encapsulated around a perforating gun that includes multiple shaped charges configured to be fired to form multiple perforations in a wellbore formed in a subterranean zone. The perforating gun encapsulated by the sheath is lowered to a depth within the wellbore. The perforating gun is triggered to fire the multiple shaped charges causing the multiple perforations to be formed in the wellbore and causing the powdered acid to be released onto the subterranean zone at the depth through the multiple perforations.

An aspect combinable with any other aspect can include the following features. Before lowering the perforating gun encapsulated by the sheath to the depth within the wellbore, the perforating gun is pressure tested to confirm absence of leakage.

An aspect combinable with any other aspect can include the following features. Before lowering the perforating gun encapsulated by the sheath to the depth within the wellbore, the wellbore is at least partially filled with fluid from a bottom of the wellbore to the depth in the subterranean zone.

An aspect combinable with any other aspect can include the following features. After triggering the perforating gun, additional fluid is flowed into the wellbore to flow the released powdered acid into the subterranean zone through the multiple perforations.

An aspect combinable with any other aspect can include the following features. A decrease in a pressure over time to flow the additional fluid into the subterranean zone through the multiple perforations is periodically measured. The additional fluid is continued to be flowed from the surface of the wellbore into the subterranean zone at the depth until the pressure reaches a threshold pressure value.

An aspect combinable with any other aspect can include the following features. A hydraulic fracturing of the subterranean zone at the depth is initiated after triggering the perforating gun to fire the multiple shaped charges.

An aspect combinable with any other aspect can include the following features. The hydraulic fracturing is initiated after flowing the additional fluid into the wellbore.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes perforating a casing in a wellbore. In some implementations, a perforating gun is covered with a sheath carrying powdered acid. When the perforating gun is lowered to a desired depth in a wellbore and the shaped charges on the perforating gun are fired, the casing is perforated. The firing of the shaped charges causes the powdered acid carried in the sheath to be applied to (for example, contact) the subterranean zone. The contact alone or the contact in combination with conditions in the wellbore at the depth of the perforating gun (for example, the perforating conditions or the wellbore conditions or both) causes a chemical reaction of the subterranean zone with the powdered acid that results in the weakening of the subterranean zone. In addition, in some instances, the perforating action of the perforating gun forms fractures in the subterranean zone which, in combination with the reaction with the powdered acid, weakens the subterranean zone and facilitates hydraulic fracturing of the subterranean zone.

Implementing the techniques described in this disclosure enables placing acid in a suitable quantity at a depth of perforations in the wellbore so that the powdered acid can be applied to and react with the subterranean zone at the instance of or just after perforating. The dimensions of the sheath allow using a larger quantity of acid compared to acid that can be carried in a perforating liner. Implementing the techniques described here can allow on-site change-out of material at the well site by switching out the sheath of the perforating gun. The thickness and length of the sheath can be varied as required. In some instances, multiple sheaths can be disposed on the same perforating gun. Each sheath can carry a quantity of powdered acid, and can be broken by firing separate sets of shaped charges on the perforating gun at a respective depth within the wellbore to apply the quantity of powdered acid carried by a respective sheath to the subterranean zone at the respective depth. Implementing the techniques described here can also minimize or negate the need to leave liquid acid in the wellbore for a long period of time during injection into the wellbore or the use of coiled tubing when fracturing the subterranean zone.

Figure 1A:
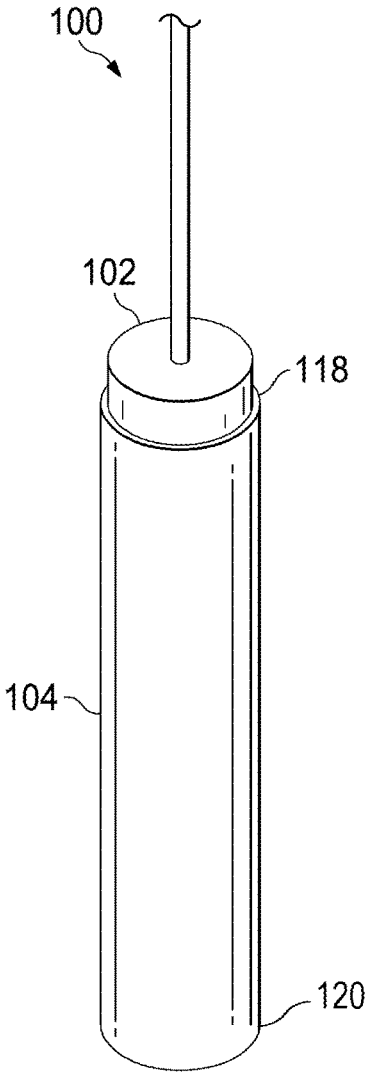
FIG. 1A is a schematic diagram of a well tool including a perforating gun encapsulated by a sheath.

FIG. 1A is a schematic diagram of a well tool 100 including a perforating gun 102 encapsulated by a sheath 104. The perforating gun 102 includes multiple shaped charges (for example, a first shaped charge 106*a*, a second shaped charge 106*b*, a third shaped charge 106*c* and so on). The perforating gun 102 is configured to be lowered to a depth into a wellbore formed in a subterranean zone. The multiple shaped charges are configured to be fired to form multiple perforations in the wellbore at the depth. The multiple perforations provide access to the subterranean zone at the depth.

The sheath 104 encapsulates the perforating gun 102. The sheath 104 covers at least some or all of the multiple shaped charges. The sheath 104 is configured to break responsive to at least some of the multiple shaped charges being fired. The sheath 104 defines an internal chamber 116 (FIG. 1B). Powdered acid is carried in the internal chamber 116 defined by the sheath 104. The acid is in powder or solid-like form. The powdered acid is configured to react with the subterranean zone when applied to the subterranean zone responsive to at least some of the multiple shaped charges being fired. The reaction weakens the subterranean zone at the depth to ease flow of hydraulic fracturing fluid into the subterranean zone at the depth, for example, by reducing formation fracture pressure at the depth.

FIG. 1B is a schematic diagram of a cross-sectional view of the sheath 102 of the well tool of FIG. 1A. The sheath 102 is a hollow, annular, cylindrical member that includes an inner wall 112 and an outer wall 114 connected by a first end wall 118 (FIG. 1A) and a second end wall 120 (FIG. 1A). When the well tool 100 is deployed in a wellbore, the first end wall 118 and the second end wall 120 are at an uphole end and a downhole end, respectively, of the well tool 100. The four walls define the internal chamber 116 in which the powdered acid is carried. A volume of the internal chamber 116 is sufficient to carry a quantity of the powdered acid needed to weaken the subterranean zone at the depth to ease flow of hydraulic fracturing fluid into the subterranean zone at the depth upon application of the quantity to the subterranean zone at the depth, responsive to at least some of the multiple shaped charges being fired.

The sheath 104 defines an inner diameter that is at most as large as the outer diameter of the perforating gun 102 that the sheath 104 encapsulates. For example, the inner diameter of the sheath 104 is equal to or more than the outer diameter of the perforating gun 102. The inner diameter of the sheath 104 is chosen such that the sheath 104 snugly fits around the outer surface of the perforating gun 102. In addition, the fit of the sheath 104 around the perforating gun 102 is such that, when the sheath 104 is broken by the firing of the multiple shaped charges, the broken sheath 104 separates from the perforating gun 102. Also, the sheath has a longitudinal length (that is, a distance between the first end wall 118 and the second end wall 120) that is sufficient to cover all of the shaped charges carried by the perforating gun 102. In some implementations, the second end wall 120 entirely covers a bottom surface of the perforating gun 102.

The thickness of the sheath 104 (that is, a distance between the inner wall 112 and the outer wall 114) is chosen such that an outer diameter of the sheath 104 is smaller than an inner diameter of the wellbore (for example, the casing in which the well tool 100 is deployed) so that the well tool 100 can be lowered into and raised out of the wellbore. In some implementations, the thickness of the sheath 104 is thin enough so that the outer diameter of the sheath 104 is smaller than the smallest restriction in the wellbore above the planned perforations. Such restrictions can be formed by locating nipples with certain profiles used for operations such as depth locating, setting plugs, etc. Example thicknesses of sheaths based on perforating gun sizes and tubings are shown in Table 1 below.

TABLE 1

Possible Acid Sheath Sizing
R Nipple Sizes Only (does not include other lock profiles)
Not a complete listing of all size combinations

| Tubing Size (inches) | Nipple ID (inches) | Threaded/Bolted Gun Size (inches) | Sheath Thickness (inches) |
|---|---|---|---|
| 2-3/8" | 1.781 | 1.563" | 1/8" |
| 2-3/8" | 1.710 | 1.563" | 1/8" |
| 2-3/8" | 1.500 | N/A | N/A |
| 2-7/8" | 2.188 | 1-11/16" | 1/8"-1/4" |
| 2-7/8" | 2.125 | 1-11/16" | 1/8"-1/4" |
| 2-7/8" | 2.000 | 1-11/16" | 1/8" |
| 2-7/8" | 1.875 | 1.563" | 1/8" |
| 3-1/2" | 2.562 | 2.125"-1-11/16" | 1/8"-1/2" |
| 3-1/2" | 2.313 | | 1/8"-3/8" |
| 3-1/2" | 2.188 | | 1/8"-3/8" |
| 4" | 3.250 | 3.00"-2.00" | 1/8"-1" |
| 4" | 3.125 | 2-7/8"-2.00" | 1/8"-1" |
| 4-1/2" | 3.813 | 3.125"-2.00" | 1/4"-1-1/2" |
| 4-1/2" | 3.750 | 3.125"-2.00" | 1/4"-1-1/2" |
| 4-1/2" | 3.688 | 3.125"-2.00" | 1/4"-1-1/2" |
| 4-1/2" | 3.630 | 3.125"-2.00" | 1/4"-1-1/2" |
| 4-1/2" | 3.437 | 3.125"-2.00" | 1/4"-1-1/4" |
| 5" | 4.125 | 3-3/8"-2-7/8" | 1/2"-1-1/4" |
| 5" | 4.000 | 3-3/8"-2-7/8" | 1/2"-1" |
| 5-1/2" | 4.562 | 4.00"-2-7/8" | 1/2"-1-1/2" |
| 5-1/2" | 4.313 | 3-3/8"-2-7/8" | 1/2"-1-1/4" |
| 6" | 5.250 | 4-5/8"-3-1/8+41" | 1/2"-2" |
| 6-5/8" | 5.625 | 5-1/8"-3-1/8" | 1/2"-2" |
| 7" | 5.963 | 5-1/8"-3-1/8" | 1/2"-2-1/4" |
| 7" | 5.875 | 5-1/8"-3-1/8" | 1/2"-2-1/4" |

The sheath 104 is made of a material that does not react with the powdered acid carried in the internal chamber 116. At the same time, the material breaks in response to the shaped charges being fired, and, once broken, the broken sheath 104 separates from (for example, slips off of) the perforating gun 102. In addition, the material is sufficiently rugged to operate as intended under wellbore conditions (for example, wellbore temperatures and pressures) and when well fluids contact and flow past the sheath 104. For example, the material should be able to retain its structural integrity for a sufficient amount of time to act as a container in the wellbore conditions until the well is perforated. In some implementations, the sheath 104 is made of a self-degradable polymer such as polyester, polyactide, polyanhydrides or similar materials.

Figure 1C:
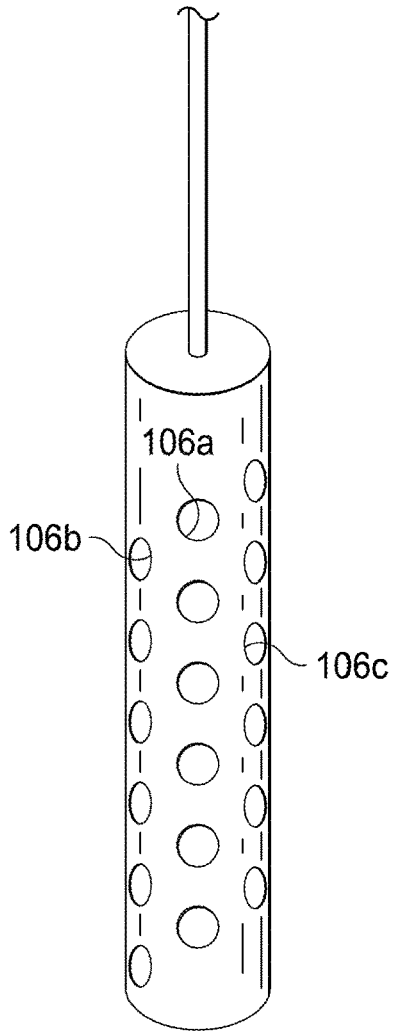
FIG. 1C is a schematic diagram of the well tool of FIG. 1A showing the sheath broken responsive to shaped charges of the perforating gun firing.
Figure 1B:
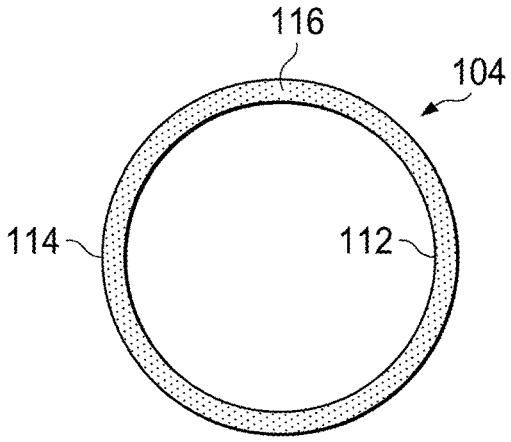
FIG. 1B is a schematic diagram of the perforating gun in the well tool of FIG. 1A.

FIG. 1C is a schematic diagram of the perforating gun 102 in the well tool 100 of FIG. 1A. Specifically, the schematic diagram of FIG. 1B shows the well tool 100 without the encapsulating sheath 104. The perforating gun 102 is used to initiate formation and breakdown by detonating high-performance deep-penetrating or big hole shaped charges that maximize perforation length or entry hole size, respectively, to start a hydraulic fracturing to enhance hydrocarbon production and optimize workflow. The dimensions of the perforating gun 102 can be selected based on dimensions of the wellbore in which the perforating gun 102 is deployed. For example, the largest diameter of the perforating gun 102 can be selected to be smaller than an inner diameter of the wellbore or an inner diameter of a casing installed in the wellbore. In operation, the perforating gun 102 is lowered to a desired depth in the wellbore, and the perforating gun 102 is triggered causing the multiple shaped charges to fire. In a cased wellbore, the resulting explosion forms perforations (that is, openings) in the casing and the cement in the annulus defined by the casing and the wellbore. The multiple shaped charges can be selected to have an explosive power such that the resulting explosion additionally forms fractures in the subterranean zone adjacent the perforations. Similar fractures can be formed in an open wellbore that lacks the casing and the cement.

In some implementations, the sheath 104 carrying the powdered acid covers the entire portion of the perforating gun 102 that has the shaped charges. In instances in which the sheath 104 is shorter than the portion of the perforating gun 102 that has the shaped charges, or in which multiple perforating guns are connected end-to-end, more than one sheath 104 can be used to cover the shaped charges. In instances in which the same perforating gun 102 is used to perforate multiple different intervals, the perforating gun 102 can carry multiple sheaths, each covering less than all the shaped charges on the perforating gun 102. In such instances, each sheath can carry a respective batch of powdered acid. When a particular subset of the shaped charges are discharged, the batch of acid carried by only the sheath covering that subset can be transferred to the formation. In this manner, the same perforating gun 102 can be used to apply powdered acid to different depths in the wellbore. Alternatively or in addition, one portion of the perforating gun 102 that carries a subset of the shaped charges could be covered by the sheath 104 while another portion is sheath-free. In such instances, acid can be applied to the formation at certain depths but not at other depths.

Figure 1D:
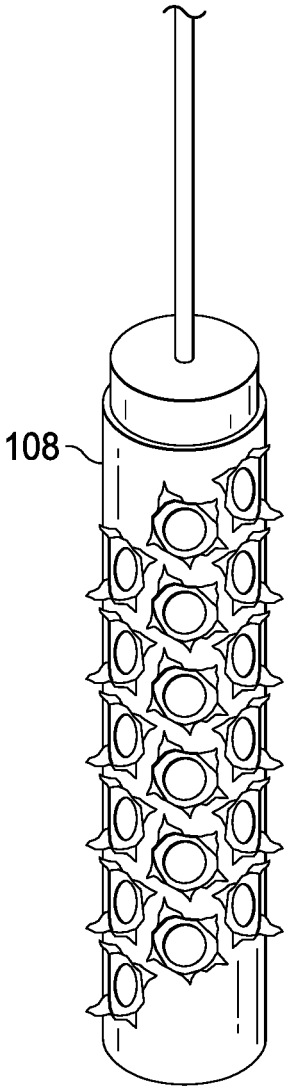
FIG. 1D is a schematic diagram of the well tool of FIG. 1A showing the broken sheath separating from the perforating gun.
Figure 1E:
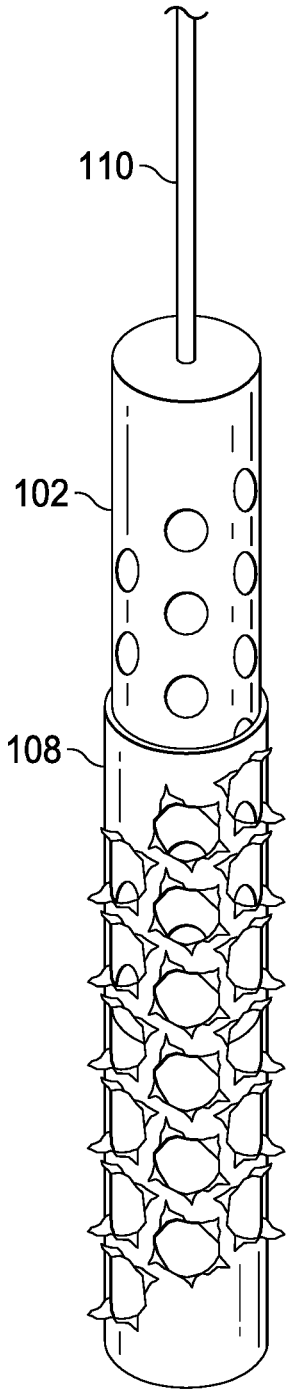
FIG. 1E is a schematic diagram of a perspective view of the sheath of the well tool of FIG. 1A.

FIG. 1D is a schematic diagram of the well tool 100 of FIG. 1A showing the a broken sheath 108 responsive to shaped charges of the perforating gun firing. The schematic diagram of FIG. 1D shows a deployment stage of the well tool 100 with the multiple shaped charges (for example, at least the multiple shaped charges covered by the sheath 104) have fired responsive to the perforating gun 102 being triggered. The explosions resulting from the firing of the multiple shaped charges has formed perforations in the wellbore as well as fractures in the subterranean zone adjacent the perforations. The broken sheath 108 releases the powdered acid carried in the internal chamber 116 of the sheath 104, and the applied pressure push the powdered acid through the perforations and into the fractures. In some implementations, the sheath 104 is an encapsulation that encapsulates the perforating gun 102 similarly to a pill being encapsulated. The firing of the multiple shaped charges breaks the encapsulation causing the broken sheath 108 to break away and separate from the perforating gun 102, as shown in FIG. 1E, causing the powdered acid to be spent. The sheath material is degradable in wellbore conditions such that the broken sheath degrades after separating from the perforating gun 102.

The powdered acid is configured to not react with the sheath 104 or the perforating gun 102 before or after the shaped charges are fired. Instead, the powdered acid is configured to react with the formation adjacent the perforations in the wellbore. Also, the powdered acid does not affect (for example, inhibit or enhance) a quality of the explosions caused by firing the shaped charges. To clarify, prolonged exposure of the perforating gun 102 or other well components (for example, the casing) to the powdered acid can cause the perforating gun 102 or the other well components to corrode. As described later, such prolonged exposure is avoided by flowing the powdered acid into the formation after the perforations have been formed. The powdered acid is selected to not react with the sheath 104 or the perforating gun 102 for a duration of time sufficient to deploy the well tool 100 and to trigger the multiple shaped charges to form the perforations. Examples of the powdered acid include hydrochloric acid, hydrofluoric acid, acetic acid, and formic acid. In some, the firing of the shaped charges break up the sheath 104 and exposes the powdered acid to the formation. The powdered acid chemically reacts with the formation to weaken the formation fracturing pressure.

In some implementations, the well tool 100 is lowered into the wellbore by a wireline 110. Alternatively, a slickline, coiled tubing or any conveyance tool can be used to lower the well tool 100 to the depth in the wellbore.

Figure 2A:
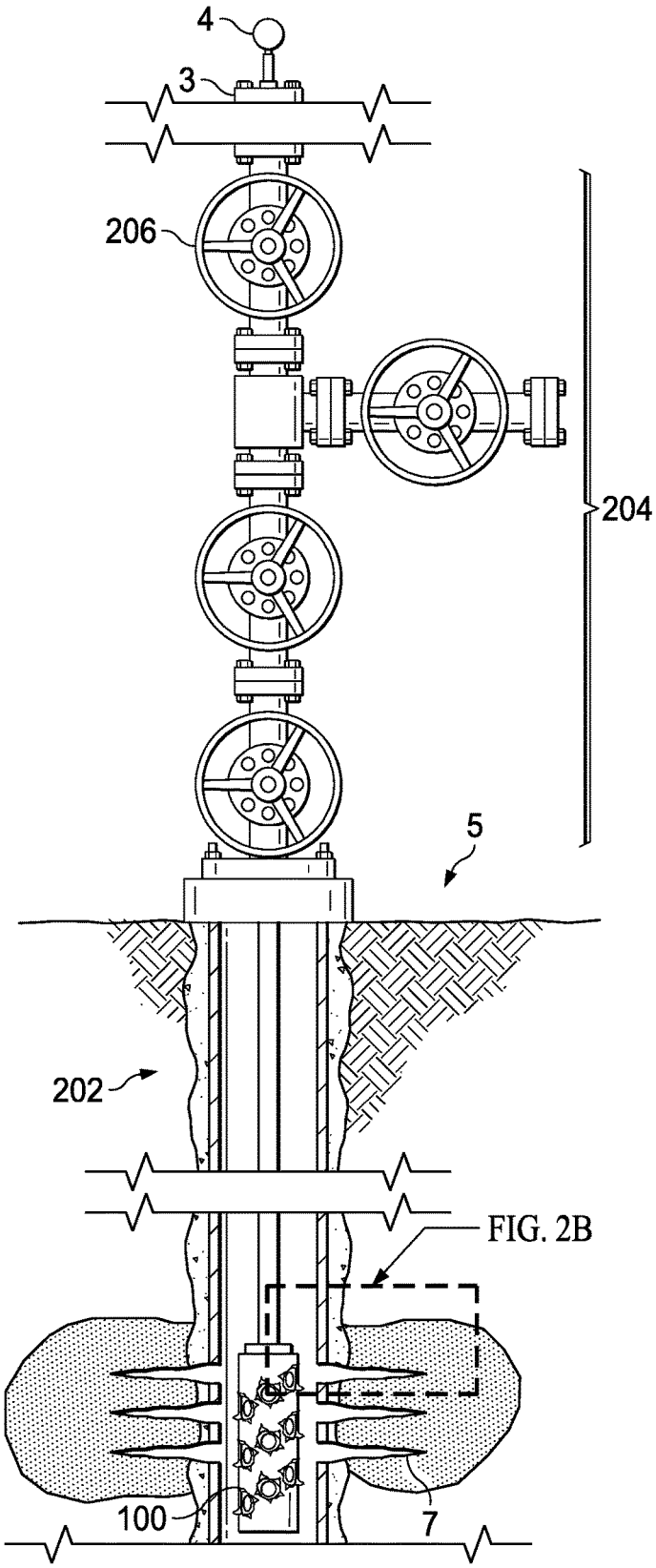
FIG. 2A is a schematic diagram of a well system in which the well tool of FIG. 1A is deployed.
Figure 2B:
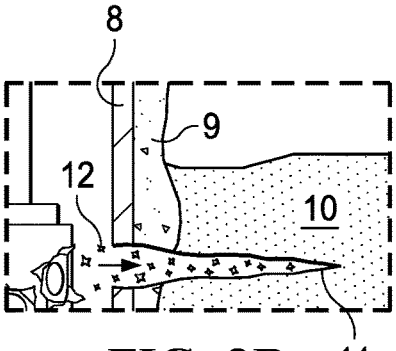
FIG. 2B is a schematic diagram of powdered acid being released from the well tool.

FIG. 2A is a schematic diagram of a well system in which the well tool 100 of FIG. 1A is deployed inside a wellbore 202. The well system includes a Christmas tree 204, which includes a valve 206, a wireline lubricator 208, and a pressure gauge 210 above a level 212 of a wellhead at the surface of the wellbore 202. The well tool 100 is deployed to a depth within the wellbore 202 at which the wellbore 202 is to be perforated. In the example well system shown in FIG. 2A, the wellbore 202 is cased and includes a casing 214 held in place by cement 216 in the annulus between the casing 214 and the subterranean zone 218. As described earlier, after deploying the well tool 100 to the depth in the wellbore 202, the perforating gun 102 is triggered causing the shaped charges to fire. The resulting explosion causes multiple actions, nearly simultaneously—breaking of the sheath 104 releasing the powdered acid, perforating of the casing 214 and the cement 216, formation of a fracture 220 in the subterranean zone 218, and the pushing of the released, powdered acid into the fracture 220 through perforation in the casing 214 and the opening in the cement 216, as shown in FIG. 2B. These actions occur at multiple locations in the subterranean zone 218 along a length of the wellbore 202 that the well tool 100 spans. Consequently, multiple fractures are formed in the subterranean zone and the powdered acid is pushed into all the fractures causing the powdered acid to contact and react with the subterranean zone, thereby weakening the formation fracturing pressure.

In some instances, not all the powdered acid carried in the sheath 104 will be pushed into the fractures through the perforations in the casing solely by the explosion resulting from firing the multiple shaped charges. In such instances, the well system pumps fluid from the surface downhole causing any powdered acid that remains within the wellbore 202 to be flowed into the subterranean zone 218, specifically, into the fractures, through the perforations. Examples of the fluid pumped into the wellbore include completion brine, treated water, or similar fluids normally pumped into the wellbore for pressure testing. The pressure applied by the pump fluids pushed any remaining powdered acid into the fractures and reducing formation fracturing pressure. In some implementations, fluid is flowed into the well before triggering the shaped charges. Doing so places the well in an overbalanced condition preventing fluids in the subterranean zone from entering the formation.

Figure 3:
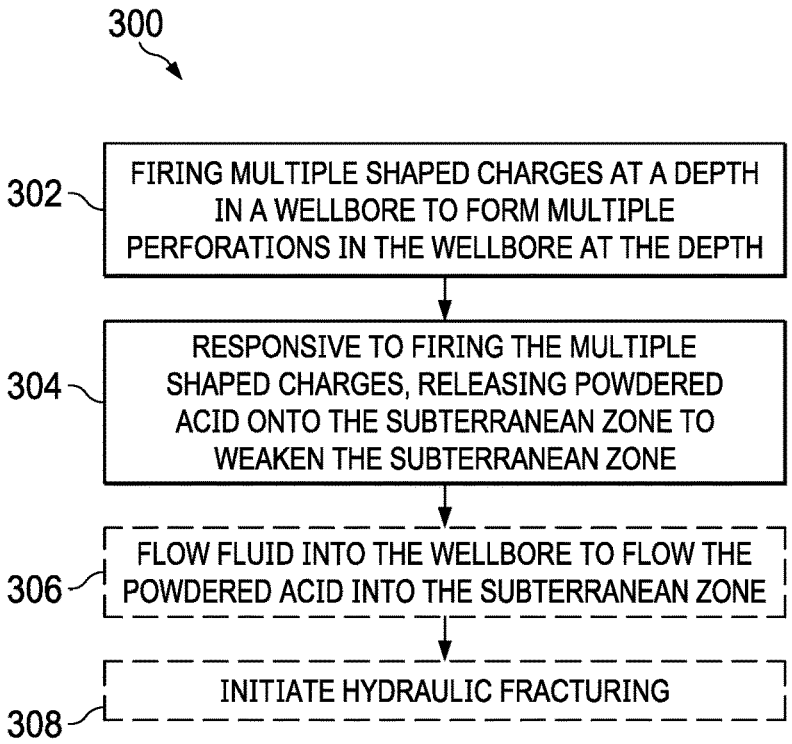
FIG. 3 is a flowchart of an example of a process implemented by the well tool of FIG. 1A.

FIG. 3 is a flowchart of an example of a process 300 implemented by the well tool 100 of FIG. 1A. The process 300 can be implemented, in part, by the well tool 100 and, in part, by other well components described above. At 302, multiple shaped charges are fired at a depth in a wellbore formed in a subterranean zone to form multiple perforations in the wellbore to provide access to the subterranean zone at the depth. At 304, powdered acid is released into the subterranean zone through the multiple perforations responsive to firing the multiple shaped charges. The powdered acid reacts with and weakens the subterranean zone at the depth to ease flow of hydraulic fracturing fluid into the subterranean zone at the depth. In some implementations, the firing of the multiple shaped charges alone is sufficient to push all the powdered acid onto the subterranean zone and into the fractures. In some implementations, some of the powdered acid is not applied to the subterranean zone. In such implementations, at 306, fluid is flowed into the wellbore to flow the powdered acid into the subterranean zone. The fluid mixes with remaining powdered acid in the wellbore and flows into the subterranean zone. The fracture formation pressure of the subterranean zone is weakened upon being contacted by the powdered acid. In some implementations, a pressure in the wellbore is measured while the fluid is pumped. As the powdered acid reacts with the wellbore and weakens the wellbore, the fluid will begin to enter the subterranean zone and the measured pressure will decrease. The fluid can continue to be flowed and the decrease in pressure over time can be measured until the wellbore pressure decreases below a threshold pressure value. The threshold pressure value is a pressure at which the hydraulic fluid can be flowed into the subterranean zone. Subsequently, at 308, hydraulic fracturing is initiated to create hydrocarbon conductivity pathways in the subterranean zone. Then, hydrocarbons entrapped in the subterranean zone can be produced into the wellbore.

Figure 4:
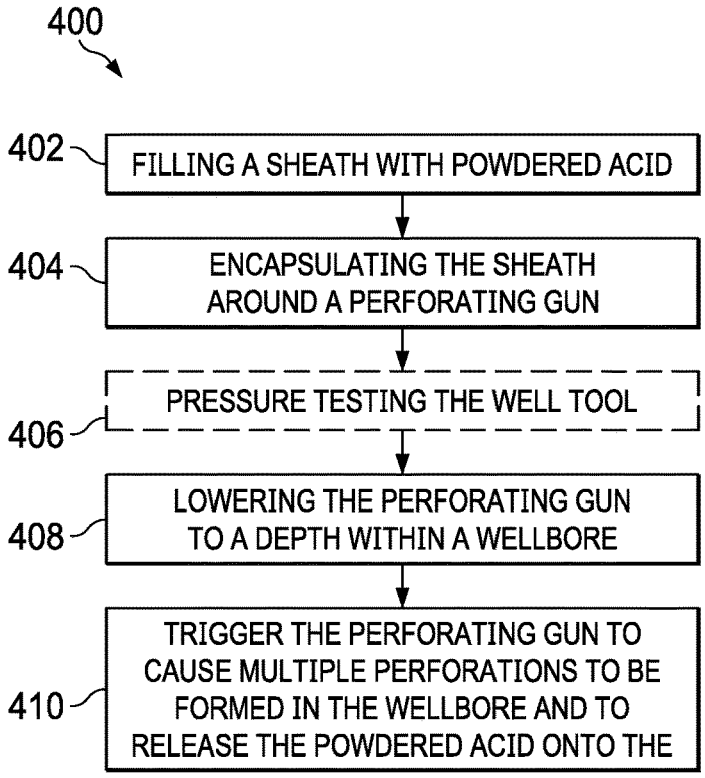
FIG. 4 is a flowchart of an example of a process of deploying the well tool of FIG. 1A.

FIG. 4 is a flowchart of an example of a process 400 of deploying the well tool 100 of FIG. 1A. The process 400 can be implemented by an operator of a wellbore. At 402, a sheath (for example, the sheath 104) is filled with powdered acid that is configured to react with a subterranean zone when applied to the subterranean zone to weaken the subterranean zone to ease flow of hydraulic fracturing fluid into the subterranean zone. At 404, the sheath is encapsulated around a perforating gun (for example, the perforating gun 102) that includes multiple shaped charges configured to be fired to form multiple perforations in a wellbore formed in the subterranean zone. In some implementations, at 406, the perforating gun with the sheath is pressure tested at the surface of the wellbore, for example, in a lubricator or similar pressure control equipment. The pressure test ensures that the equipment can work under the wellbore conditions. At 408, the perforating gun and the sheath carrying the powdered acid are lowered into the wellbore to a depth, for example, the depth at which the wellbore is to be perforated. At 410, the perforating gun is triggered to fire the multiple shaped charges causing the multiple perforations to be formed in the wellbore and causing the powdered acid to be released into the subterranean zone at the depth through the multiple perforations. The operations cause the powdered acid to enter the subterranean zone through fractures, and to react with and weaken the subterranean zone, as described earlier.

In some implementations, before lowering the perforating gun encapsulated by the sheath to the depth within the wellbore, the wellbore is at least partially filled with fluid from a bottom of the wellbore to the depth in the subterranean zone. By pressurizing the well in this manner, the well can be placed in an overbalanced condition before triggering the perforating gun. In some implementations, after triggering the perforating gun, additional fluid is flowed into the wellbore to flow the released powdered acid into the subterranean zone through the multiple perforations. In some implementations, a pressure in the wellbore is measured while the fluid is pumped. As the powdered acid reacts with the wellbore and weakens the wellbore, the fluid will begin to enter the subterranean zone and the measured pressure will decrease. The fluid can continue to be flowed and the decrease in pressure over time can be measured until the wellbore pressure decreases below a threshold pressure value. The threshold pressure value is a pressure at which the hydraulic fluid can be flowed into the subterranean zone. Subsequently, hydraulic fracturing is initiated to create hydrocarbon conductivity pathways in the subterranean zone. Then, hydrocarbons entrapped in the subterranean zone can be produced into the wellbore.

In implementations in which the span of the wellbore to be perforated is longer than a length of the perforating gun, multiple stages of the operations described earlier can be performed. In a first instance, a first zone of the subterranean zone can be perforated. In this first instance, there are no other perforations in the wellbore. In a second instance following the first instance, a second zone of the subterranean zone, for example, uphole of the first zone, can be perforated. In the second instance, a plug, a seal, a packer or similar isolation device is positioned between the first zone and the second zone so that fluid flowed into the wellbore is not lost into the first zone. Then, the second zone is perforated as described earlier.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

The invention claimed is:

1. A well tool comprising:

a perforating gun comprising a plurality of shaped charges, the perforating gun configured to be lowered to a depth into a wellbore formed in a subterranean zone, the plurality of shaped charges configured to be fired to form a plurality of perforations in the wellbore at the depth, the plurality of perforations providing access to the subterranean zone at the depth;

a sheath encapsulating the perforating gun, the sheath covering at least some of the plurality of shaped charges, the sheath configured to break responsive to at least some of the plurality of shaped charges being fired, the sheath defining an internal chamber, wherein the sheath is a hollow, annular member comprising an inner wall and an outer wall connected by a first end wall and a second end wall, wherein the sheath encapsulates an entire length of the perforating gun and substantially the ends of the perforating gun; and powdered acid carried in the internal chamber defined by the sheath, wherein the powdered acid is configured to react with the subterranean zone when applied to the subterranean zone responsive to at least some of the plurality of shaped charges being fired, the powdered acid configured to react with and weaken the subterranean zone at the depth to ease flow of hydraulic fracturing fluid into the subterranean zone at the depth.

2. The well tool of claim 1, wherein the sheath defines an inner diameter that is at least as large as an outer diameter of the perforating gun.

3. The well tool of claim 1, wherein the internal chamber is defined between the inner wall, the outer wall, the first end wall, and the second end wall, wherein a volume of the internal chamber is sufficient to carry a quantity of the powdered acid needed to weaken the subterranean zone at the depth to ease flow of hydraulic fracturing fluid into the subterranean zone at the depth upon application of the quantity to the subterranean zone at the depth responsive to at least some of the plurality of shaped charges being fired.

4. The well tool of claim 1, wherein, responsive to at least some of the plurality of shaped charges being fired, the sheath is configured to separate from the perforating gun.

5. The well tool of claim 1, wherein the powdered acid is configured to not react with the sheath or the perforating gun before or after at least some of the plurality of shaped charges are fired.

6. The well tool of claim 1, wherein the powdered acid comprises at least one of hydrochloric acid, hydrofluoric acid, acetic acid, or formic acid.

7. The well tool of claim 1, further comprising a wireline coupled to the sheath, the wireline configured to lower the well tool into the wellbore to the depth.

8. A method comprising:

firing, by a perforating gun, a plurality of shaped charges at a depth in a wellbore formed in a subterranean zone to form a plurality of perforations in the wellbore to provide access to the subterranean zone at the depth;

responsive to firing the plurality of shaped charges, releasing, by a sheath carrying powdered acid and encapsulating the perforating gun, the powdered acid onto the subterranean zone through the plurality of perforations, wherein the powdered acid reacts with and weakens the subterranean zone at the depth to ease flow of hydraulic fracturing fluid into the subterranean zone at the depth; and flowing the released powdered acid into the subterranean zone at the depth after releasing the powdered acid responsive to firing the plurality of shaped charges, wherein the released powdered acid is flowed into the subterranean zone by mixing the released powdered acid with a fluid flowed from a surface of the wellbore into the subterranean zone at the depth.

9. The method of claim 8, further comprising:

periodically measuring a decrease in a pressure over time to flow the fluid into the subterranean zone; and continuing to flow the fluid from the surface of the wellbore into the subterranean zone at the depth until the pressure reaches a threshold pressure value.

10. The method of claim 8, further comprising initiating a hydraulic fracturing of the subterranean zone at the depth after flowing the released powdered acid into the subterranean zone.

11. A method comprising:

filling an internal chamber defined by a sheath with powdered acid that is configured to react with a subterranean zone when applied to the subterranean zone to weaken the subterranean zone to ease flow of hydraulic fracturing fluid into the subterranean zone;

encapsulating the sheath around a perforating gun comprising a plurality of shaped charges configured to be fired to form a plurality of perforations in a wellbore formed in the subterranean zone;

lowering the perforating gun encapsulated by the sheath to a depth within the wellbore;

triggering the perforating gun to fire the plurality of shaped charges causing the plurality of perforations to be formed in the wellbore and causing the powdered acid to be released onto the subterranean zone at the depth through the plurality of perforations; and after triggering the perforating gun, flowing additional fluid into the wellbore to flow the released powdered acid into the subterranean zone through the plurality of perforations.

12. The method of claim 11, further comprising, before lowering the perforating gun encapsulated by the sheath to the depth within the wellbore, pressure testing the perforating gun to confirm absence of leakage.

13. The method of claim 11, further comprising, before lowering the perforating gun encapsulated by the sheath to the depth within the wellbore, at least partially filling the wellbore with fluid from a bottom of the wellbore to the depth in the subterranean zone.

14. The method of claim 11, further comprising:

periodically measuring a decrease in a pressure over time to flow the additional fluid into the subterranean zone through the plurality of perforations; and continuing to flow the additional fluid from the surface of the wellbore into the subterranean zone at the depth until the pressure reaches a threshold pressure value.

15. The method of claim 11, further comprising initiating a hydraulic fracturing of the subterranean zone at the depth after triggering the perforating gun to fire the plurality of shaped charges.

16. The method of claim 15, wherein the hydraulic fracturing is initiated after flowing the additional fluid into the wellbore.

* * * * *